US007226245B2

(12) United States Patent
Kent et al.

(10) Patent No.: US 7,226,245 B2
(45) Date of Patent: Jun. 5, 2007

(54) MODULAR MARINE STRUCTURES

(75) Inventors: Eliyahu Kent, 1, Basil Street, Herzelyia 46660 (IL); Yoram Alkon, P.O. Box 3605, Jerusalem (IL) 91030

(73) Assignees: Eliyahu Kent, Herzelyia (IL); Yoram Alkon, Jerusalem (IL); Tamnor Management & Consulting Ltd., Nethanya (IL)

( * ) Notice: Subject to any disclaimer, the term of this patent is extended or adjusted under 35 U.S.C. 154(b) by 570 days.

(21) Appl. No.: 10/482,080

(22) PCT Filed: Jun. 27, 2002

(86) PCT No.: PCT/IL02/00523

§ 371 (c)(1),
(2), (4) Date: Dec. 29, 2003

(87) PCT Pub. No.: WO03/002827

PCT Pub. Date: Jan. 9, 2003

(65) Prior Publication Data

US 2004/0182299 A1 Sep. 23, 2004

Related U.S. Application Data

(60) Provisional application No. 60/301,133, filed on Jun. 28, 2001.

(51) Int. Cl.
*B63B 35/44* (2006.01)

(52) U.S. Cl. ..... 405/195.1; 405/21; 405/26; 405/35; 52/DIG. 10; 52/648.1; 114/266

(58) Field of Classification Search ..... 405/195.1, 405/204, 15, 16, 21, 26, 35; 52/DIG. 10, 52/648.1; 114/264, 266
See application file for complete search history.

(56) References Cited

U.S. PATENT DOCUMENTS 1,875,668 A 9/1932 Sheldon (Continued)

FOREIGN PATENT DOCUMENTS

GB 1514602 6/1978

(Continued)

*Primary Examiner*—Frederick L. Lagman
(74) *Attorney, Agent, or Firm*—The Nath Law Group; Jerald L. Meyer; Stanley N. Protigal

(57) ABSTRACT

A load-carrying modular structure assembled from 3-D structural modules constituting parallelepipeds with rectangular faces, the 3-D modules adjoining each other along said faces. The modules comprise reinforcing diagonal beams (RDBs) disposed along diagonals that connect vertices of the parallelepipeds. The RDBs form a 3-D multi-tetrahedron lattice whereby said modular structure behaves under load as a multi-tetrahedron structure. A basic 3-D module for assembling the modular structure has six RDBs along facial diagonals forming a tetrahedron. The 3-D module may have RDBs also along the other six diagonals and along diagonals connecting centers of the box's faces. The 3-D modules may have cut-outs and passages for water currents. They may have internal hollow volumes and controlled buoyancy, and may be assembled from shell elements.

40 Claims, 12 Drawing Sheets

U.S. PATENT DOCUMENTS 2,028,794 A * 1/1936 Matthes ..... 405/16
2,178,667 A * 11/1939 Littlefield ..... 52/655.1
3,663,346 A * 5/1972 Schoen ..... 428/116
3,665,882 A * 5/1972 Georgiev et al. ..... 114/266
3,799,093 A 3/1974 Thomson
3,822,499 A * 7/1974 De Vos ..... 446/121
4,074,497 A * 2/1978 Ono ..... 405/195.1
4,554,883 A * 11/1985 Lane ..... 114/266
4,745,725 A * 5/1988 Onoda ..... 52/646
5,024,036 A * 6/1991 Johnson ..... 52/600
5,097,645 A * 3/1992 Sanderson ..... 52/655.1
5,105,589 A 4/1992 Rodriguez
5,107,785 A 4/1992 Baxter
5,315,806 A 5/1994 Da Casta Trias de Bes
5,505,035 A * 4/1996 Lalvani ..... 52/648.1
6,199,502 B1 3/2001 Mattson
6,205,739 B1 3/2001 Newlin

FOREIGN PATENT DOCUMENTS

JP 01127710 5/1989
JP 02120418 5/1990

* cited by examiner

MODULAR MARINE STRUCTURES

This application claims benefit of provisional application Ser. No. 60/301,133 filed Jun. 28, 2001.

FIELD OF THE INVENTION

This invention relates to methods and means for building large structures and infrastructures at land and sea from prefabricated modules.

BACKGROUND OF THE INVENTION

A preferred method in the practice of marine and coastal construction is the assembly of precast (prefabricated) steel reinforced concrete elements. It is also preferable to make the elements floating. The advantages of the floating concrete structures lie in the economy of the materials used (concrete is very well suited to a marine environment), in the fact that it is easy to make concrete structures bouyant for towing in the construction stage, as well as permanently floating, whereas they are heavy enough for a safe permanent installation, and in the fact that they can also provide storage space. Concrete structures may be constructed in a convenient, protected area then floated to the installation site. This method is used with advantage to avoid the occupation of expensive land for production site. Even if the installation site is highly exposed to the weather, the structure can be quickly positioned during a short window of favorable conditions.

The range of applications of floating and non-floating concrete structures is fairly large:

- Oil exploration, drilling and production platforms, LPG terminals;
- Barges, ships and yachts, floating docks;
- Floating, or based on the ocean floor, artificial islands, airports, power stations, industrial plants, hotels, shopping centers, bridges, semi-submersible tunnels, lighthouses, breakwaters, etc.

Large structures can be assembled from precast components integrated by cast-in-place joints or by match-cast joints. A combined application of precast and cast-in-place elements is also possible. Precasting allows thin sections of high-strength concrete to be obtained.

An additional advantage is obtained by making the precast components modular, i.e. when structures are assembled from a plurality of large, essentially identical modules. Thus, JP 01127710 discloses a method for construction of a marine structure such as a platform or an artificial island, from hollow modules with rounded bottoms, about 10 m in diameter and 5 m deep. The modules may be shaped as rectangular or hexagonal boxes, or as cylinders. They are positioned by floating and are assembled in one or two directions in horizontal plane, in large floating groups that may be then towed and connected in a large marine structure.

JP 02120418 discloses a method for construction of foundations for marine structures from large hollow T-shaped blocks. The blocks have dovetail vertical channels at the connection sides and vertical wells for piles. The blocks are towed to the construction site and sunk in place. Adjacent elements are connected by steel or ferroconcrete profiles inserted in the dovetail channels, and bearing piles are driven into the sea bottom through the vertical wells. Joints are formed in the dovetail channels by injecting mortar or grout.

U.S. Pat. No. 3,799,093 discloses a pre-stressed floating concrete module for assembling wharves. The module is of rectangular box-like shape and has a core of buoyant material, pretensioned strands of steel along the edges of the box, and brackets for joining to adjacent modules in one line.

U.S. Pat. No. 5,107,785, describes a similar concrete floatation module for use in floating docks, breakwaters and the like. The box-shaped module has integral tubular liners embedded along one set of its parallel edges. Tensioning steel cables are passed through the tubular liners to maintain a line of several modules in compression in an end-to-end relation. Similar tubular liners may be provided in the transverse direction to interconnect several lines of modules. Yet another similar floating concrete module is disclosed in U.S. Pat. No. 6,199,502 where the module has also box-like shape but with slightly concave abutting sides to ensure more stable mutual positioning of the adjacent modules. There are provided passages for two transverse sets of connecting cables in each module, in two horizontal planes displaced from each other.

SUMMARY OF THE INVENTION

The present invention provides a method to assemble a large number of structural modules in a multi-tetrahedron structure with the ease of assembling cubical or box-like modules. In particular, there is provided a load-carrying modular structure assembled from 3-D structural modules, (3-D modules) constituting complete or partially cut-out parallelepipeds with rectangular faces. The 3-D modules adjoin each other along said faces. The 3-D modules comprise reinforcing diagonal beams (RDBs) disposed along diagonals (R-diagonals) connecting vertices (R-corners) of the parallelepipeds. The RDBs form a 3-D multi-tetrahedron lattice in the modular structure, whereby the modular structure behaves under load as a multi-tetrahedron structure.

In accordance with a second aspect of the present invention, there is provided a 3-D module for assembly in the above modular structure, comprising at least one RDB including reinforcing elements. The RDBs in a 3-D module may be disposed along facial R-diagonals and/or along body R-diagonals, and/or diagonals connecting centers of faces of the enclosing parallelepiped. The RDBs of a single 3-D module do not necessarily form a complete tetrahedron or octahedron—they are formed in the completed modular structure.

A preferable embodiment of the 3-D module (basic module) comprises a set of six RDBs extending along six facial diagonals (R1-diagonals) connecting four non-adjacent corners (R1-corners) of the parallelepiped. The RDBs form a tetrahedron so that the basic 3-D module behaves under load applied in any of the R1-corners essentially as a tetrahedron built of six rods connected in four vertices.

Preferably, the four other corners of the parallelepiped are cut out along four respective cut-out surfaces, and the cut-out surfaces are interconnected by four respective tunnels converging in the center of the parallelepiped in a tetrapod shape.

Preferably, the cut-out surfaces are of ellipsoid or spherical shape centered at the respective cut-out corner but they can be also of any curved or planar shape. In particular, the cut-out surfaces and the tunnels may be so shaped that portions of the 3-D module accommodating the RDBs be formed essentially as beams of uniform cross-section. Or, the cut-out surfaces and the tunnels may be shaped so as to provide a free passage for a vertical column parallel to an edge of the parallelepiped.

In another embodiment of the 3-D module of the present invention, not having cut-out corners, the module further comprises a second set of six RDBs extending along six diagonals (R2-diagonals) of the box other than the R1-diagonals, connecting four non-adjacent corners (R2-corners) thereby forming a second tetrahedron so that this double 3-D module behaves under load applied in any of the R2-corners essentially as a tetrahedron built of six rods connected in four vertices. The double 3-D module may have portions of the parallelepiped adjacent to its edges cut out, or tunnels may be cut out of the parallelepiped, each tunnel starting at one of the edges, all tunnels converging near the center of the parallelepiped. The double module may be cut out in such manner that portions of the module accommodating the RDBs will form beams of uniform cross-section extending along the R1-diagonals and the R2-diagonals. The double 3-D module may be assembled from six module elements, each module element comprising a RDB along an R1-diagonal and a RDB along an R2-diagonal.

Yet another embodiment of the present invention, a "multiple" 3-D module, comprises the two sets of RDBs incorporated in the double 3-D module, but further comprises a third set of twelve RDBs extending along twelve diagonals (R3-diagonals) connecting intersections of the R1-diagonals and the R1-diagonals. The R3-diagonals form an octahedron so that the "multiple" 3-D module behaves under load essentially as a multi-tetrahedron structure built of eight tetrahedrons arranged about one octahedron. The "multiple" 3-D module may be assembled from twelve module elements, each module element comprising one RDB along a R3-diagonal, parts of two RDBs along two R1-diagonals, and parts of two RDBs along two R2-diagonals.

Thus, the present invention is based on the known principles of structural mechanics that structures assembled from rods and vertex connectors in such forms as lattices of tetrahedrons or octahedrons (see FIGS. 3 and 4 below) are very stable and rigid. Their principal advantage is in the fact that any external load applied in the vertices is distributed as axial load in the rods. The rods therefore work only in compression or tension and not in bending, torque or shear. A plurality of such forms organized, for example, in a multi-tetrahedron structure comprising several is layers of tetrahedrons (FIG. 4), distributes a local load from one vertex very quickly and uniformly to all near-by vertices and to more distant vertices as well. That is why, such multi-tetrahedron structure does not need to be supported in every vertex that faces the foundation (the seabed, for example) but can tolerate a number of unsupported vertices, like a bridge. The multi-tetrahedron structure has many redundant connections, i.e. some of the rods could be removed without significant loss of rigidity. Consequently, such structure is extremely reliable in case of structural failure of some members, for example in accident, collision or other local damage. Furthermore, the multi-tetrahedron structure is open and isomorphic, it can grow without limitations in all directions, by simple adding of rods and vertex connectors. In fact, with the growing number of layers, this structure behaves rather like foam material with rigid walls (with very large cavities). Such materials have excellent weight-to-load ratio.

The RDBs may be reinforced by such elements as steel rods. The RDBs may be pre-tensioned or post-tensioned. The 3-D module of the present invention has recesses on the faces of the parallelepiped, at an R-diagonal thereof, which are so disposed as to define a cavity with a similar recess on another 3-D module when the two modules are arranged adjacent to each other. The cavity serves to accommodate a connection element firmly fixing the two modules to each other. Such recesses may have the form of channels extending along the R-diagonals, or may be made in the R-corners of the parellelepiped, or in other places along the R-diagonals. Preferably, parts of the reinforcing elements of the RDBs, i.e. steel rods, are exposed in the recesses, for better connection. The recesses are formed with a peripheral channel for accommodating a sealing element such as inflatable gasket to seal the cavity.

In yet another embodiment of the present invention, the 3-D module comprises a closed fluid-tight hollow volume, with a valve enabling filling and draining of the hollow volume. The hollow volume is preferably of such size that the 3-D module can float in water if the hollow volume is at least partially filled with air.

Preferably, the basic 3-D module constitutes a structural shell enclosing the hollow volume. The shell may be assembled from four shell elements with generally triangular shape, each shell element comprising one of the tunnels and parts of the RDBs, each pair of shell elements being sealingly joined by their edges along one of the R1-diagonals of the parallelepiped and along a joint of two respective tunnels.

A third aspect of the present invention provides a method of production of a 3-D structural module comprising the following steps:

a) casting four shell elements in four respective shell casting molds;

b) disposing three of the casting molds around the fourth casting mold, in a horizontal plane, and coupling the edges of the three casting molds to the edge of the fourth casting mold by means of hinges;

c) assembling a 3-D tetrahedron structure by lifting the three casting molds and turning them about the hinges; and d) bonding joints between the edges of shell elements along the R1-diagonals, and bonding the joints between the tunnels, to obtain a hollow fluid-tight 3-D structural module.

Preferably, the step (a) is performed by first casting three planar walls for each shell element and then placing the planar walls in the casting mold for the shell element. For marine structures, the steps (a) to (d) are preferably performed by using floating casting molds which are kept together with the 3-D module until ballasting, balancing and releasing the 3-D module from the floating casting molds.

A fourth aspect of the present invention provides a method for assembling a land or marine structure from 3-D structural modules, comprising the following steps:

a) transportation and fixing of at least two 3-D modules adjacent to each other and aligned so that their respective parallelepipeds have a common R-diagonal and define a cavity therebetween; and b) formation of a joint element in the cavities to bond the 3-D modules together, thereby obtaining a mechanical structure behaving under load essentially as a multi-tetrahedron structure.

A number of 3-D modules may be assembled together and then transported and fixed to another such assembly.

When the structure is a marine submerged structure, and buoyant 3-D modules with a hollow volume are used, the 3-D modules may be moved in floating state over the predetermined place and lowered to the predetermined place by controlled filling of the hollow volume with water facilitated by any other suitable means.

When the structure is erected on the ground or on the seabed it may be locally reinforced by inserting vertical pillars through spaces formed for this purpose in the 3-D modules.

A fifth aspect of the present invention provides a method of forming a cast joint in a closed space between two adjacent modules of a submerged structure. The modules are divided by a narrow gap surrounding the closed space, the narrow gap allowing the ambient water into the closed space. The method comprises:

a) providing pipes for fluid communication between the closed space and: (1) a source of pressurized air, (2) a source of flowable setting material, and (3) ambient water;

b) providing one or more inflatable tube-shaped gaskets in the narrow gap; the gaskets surround the closed space and are connected to a source of pressurized fluid;

c) inflating the gaskets with pressurized fluid so as to seal the narrow gap surrounding the closed space;

d) purging the water from the closed space via pipe (3) by feeding pressurized air via pipe (1);

e) filling the closed space with setting material via pipe (2).

The modules may have recesses constituting a part of the closed space, the is pipes in (a) may be built-in during the manufacture of the adjacent modules, or may be obtained via the narrow gap or via a surface channel in the adjacent modules. The gaskets may be accommodated in a channel made in the modules and surrounding the closed space, two sets of gaskets may be fixed to the adjacent modules, opposite to each other in the narrow gap, so that the gap could be sealed in case one of two opposing gaskets should fail to inflate. The method is suitable for casting joints between any construction elements.

The invention provides an effective method for building marine and land structures and infrastructures from prefabricated modules, characterized inter alia by the following advantages:

- The structure is assembled by piling up of box-like modules advantageously using their horizontal and vertical faces;
- The assembled structure is a spatial constructive framework built of reinforced diagonal beams, embedded in a suitable set up. The constructive connections between the modules provides for continuation of the reinforced beams in the structure and for distribution of local loads to large zones of the structure and to the foundation;
- The structure may bridge depressions in the underlying terrain (in the seabed, for example) or non-uniform foundations;
- The structure is very reliable and can survive the failure of many structural members;
- The structure is relatively lightweight and is suitable for construction in seismic regions, on weak or soft seabed, or in quick sands;
- The modules include large hollow volumes providing buoyancy for an easy transportation by waterway and assembly by floating and filling. The volumes may be also used as containers;
- The modules include large tunnels making the assembled structure permeable for water currents;
- The modules are built as shell structures providing for efficient use of the constructive material;
- The modules are made from identical shell elements cast in floating molds. The same molds can be advantageously used for assembly and transportation of the modules by water;
- The method is suitable for building artificial islands, expanding existing islands as well as reclaiming new land out at sea. It can be applied as a substitute (wholly or partially) for filling large spaces with soil, in extensive civil works, (reconstruction of abandoned quarries, etc.). It can be used in construction of bridges, dams, wharves, breakwaters, etc.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
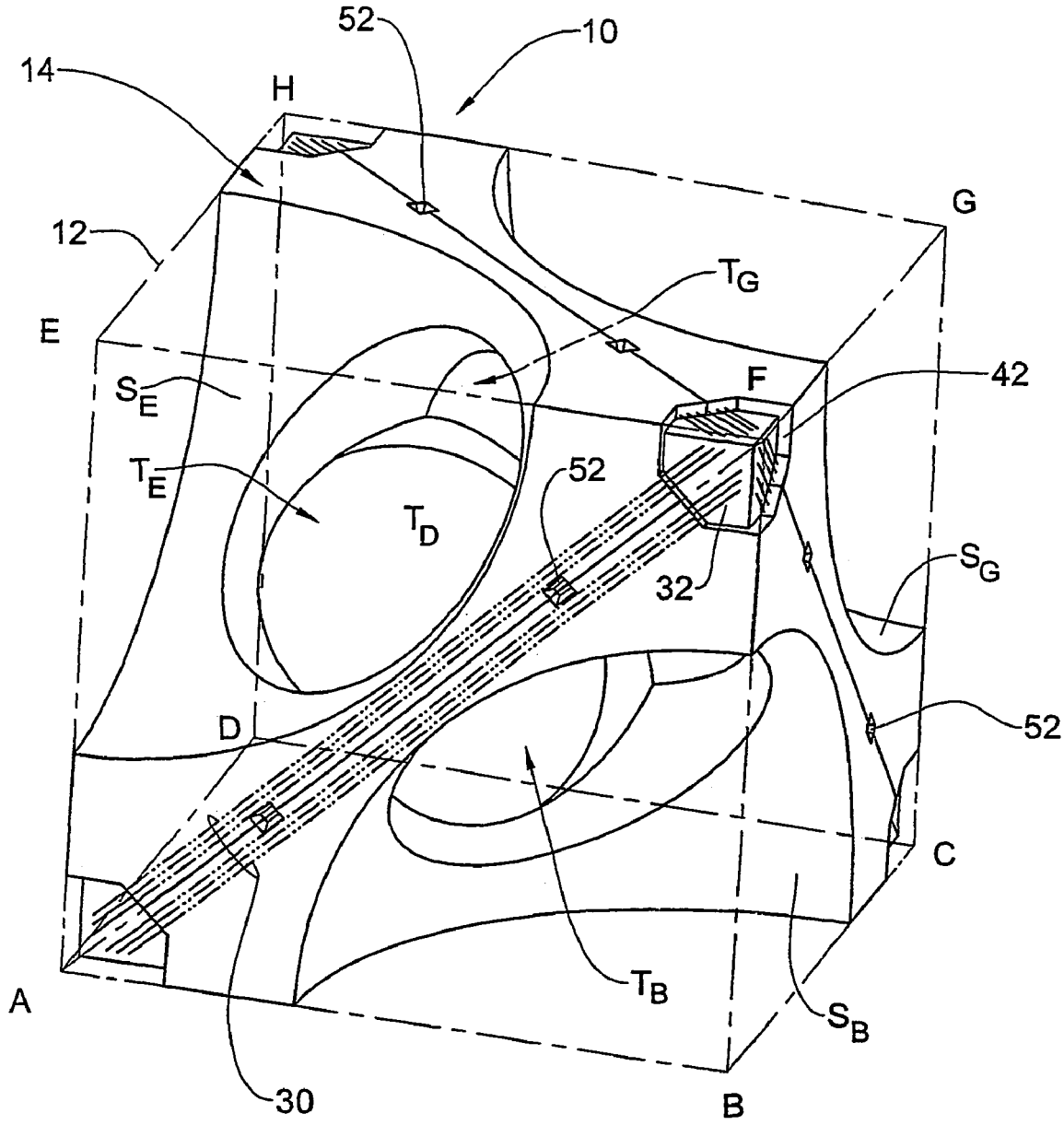
FIG. 1 is a perspective view of a basic 3-D module according to the present invention.

With reference to FIG. 1, a basic 3-D structural module 10 of the present invention (3-D module hereafter) is a modular construction unit with a shape constituting a rectangular parallelepiped 12 defined by 6 planar faces with lower base vertices ABCD and upper base vertices EFGH. In the example shown, it is assumed, without any limitations, that the parallelepiped is a geometrical cube with side about 10 m long. The shape of the basic 3-D module may be described in the following way:

Four non-adjacent corners of the cube (in this case—B, D, E, and G) are cut out by cut-out surfaces $S_B$, $S_D$ (not seen), $S_E$, and $S_G$. The cut-out surfaces shown in FIG. 1 are spherical surfaces centered in respective cut out corners of the cube but they can be of any shape bulging towards the cube's center like ellipsoid, or flat shape, or more complex shape;

Four tunnels $T_B$, $T_D$, $T_E$, and $T_G$ are formed and converge in the cube's center to form a tetrapod-like passage interconnecting the cut-out surfaces. The tunnels are shown as cylinder pipes but they may have other form;

Six planar surfaces left from the faces of the original cube, for example surface 14 (face EFGH), are base planes by which the 3-D module contacts other similar modules. These surfaces must be large enough to ensure stable positioning of the module on a substantially horizontal foundation during the assembly process, as shown below.

Figure 2:
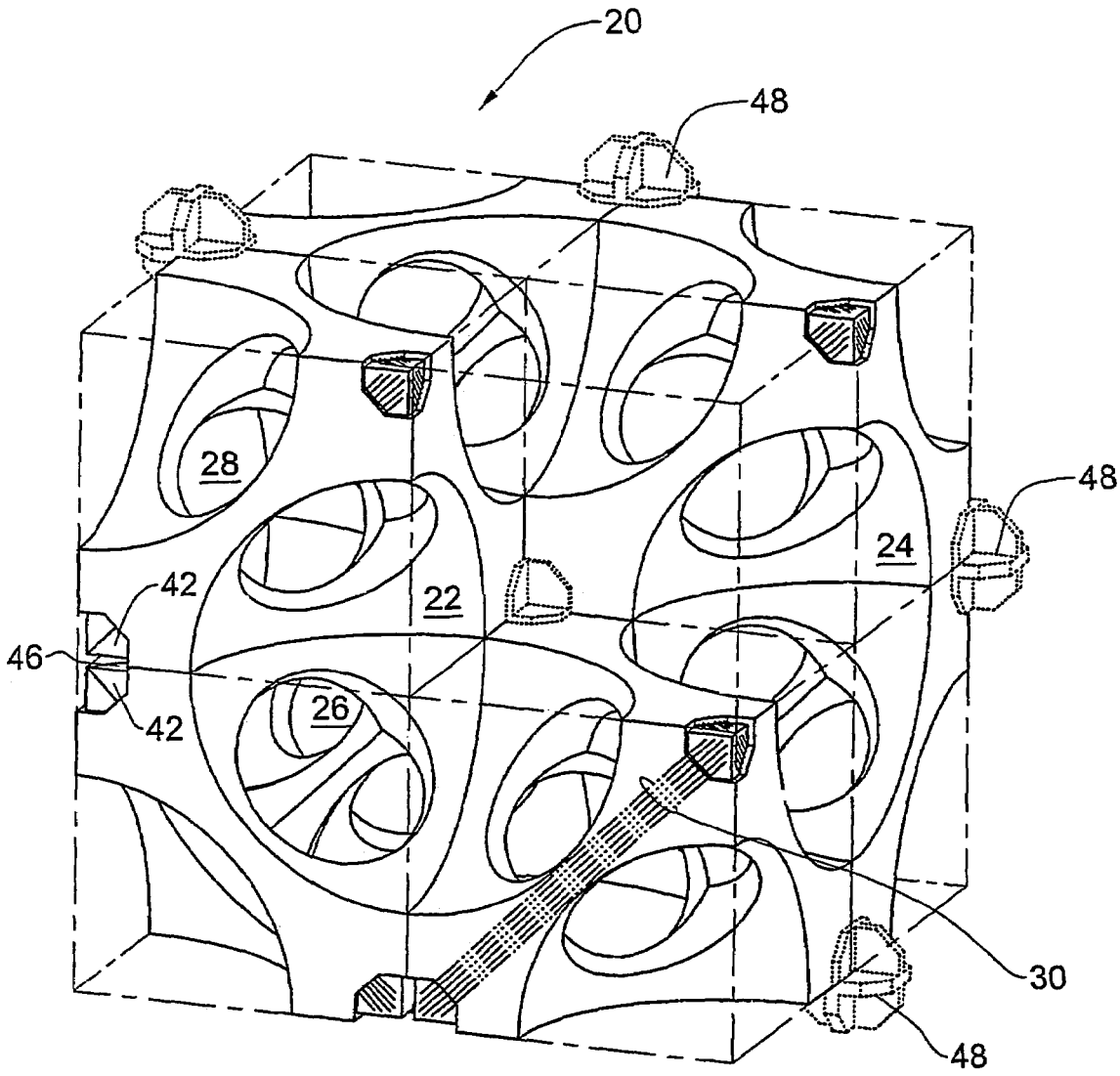
FIG. 2 is a perspective view of a structure assembled from eight 3-D modules as shown in FIG. 1.

FIG. 2 shows part of a structure 20 assembled from eight 3-D modules of the type shown in FIG. 1, arranged in two tiers (the upper front module is removed). It can be seen that piling up and assembling the 3-D modules according to the arrangement of the enclosing cube (FIG. 1) creates large spherical spaces (22, 24) interconnected by tunnels (26, 28). Thus, a submerged marine structure made of the basic 3-D modules will allow free water flow therethrough.

The 3-D modules are formed with reinforcing diagonal beams (RDBs) 30 extending along the six diagonals (AF, FC, CA, AH, HC, and HF) on the planar surfaces left from the faces of the enclosing cube. The RDBs may comprise reinforcing elements, for example steel rods 32, and material embedding the reinforcing elements, for example concrete. The RDBs are connected by three in four reinforced corners (R1-corners) A, C, F, and H of the 3-D module to form a tetrahedron shape. When the 3-D modules are loaded as part of the structure 20, the forces that are distributed through the 3-D modules are mainly concentrated along the RDBs. The structural behavior of the basic 3-D module is similar to that of a tetrahedron made of six rods 34 and four vertex connectors 36, as shown schematically in FIG. 3. The assembled structure 20 of FIG. 2 will carry loads similarly to the spatial structure 40 shown in FIG. 4, comprising plurality of tetrahedrons and octahedrons therebetween. The multi-tetrahedron 40 assembled from rods 34 and vertex connectors 36 is known in the engineering mechanics, and its principal advantage is in the fact that any external load applied in the vertices is distributed as axial load in the rods, and is distributed to a large zone of the structure, as explained above.

Thus, the inventive 3-D module provides both advantageous structural behavior and an easy and efficient way of assembling a plurality of such modules in large structures by stacking on their horizontal surfaces (such as surface 14 in FIG. 1). The four corners of the enclosing cube may be not cut out since the desired structural behavior of the 3-D module is provided by the RDBs which form a tetrahedron, not so much by the cut-out corners or tunnels.

Figure 5:
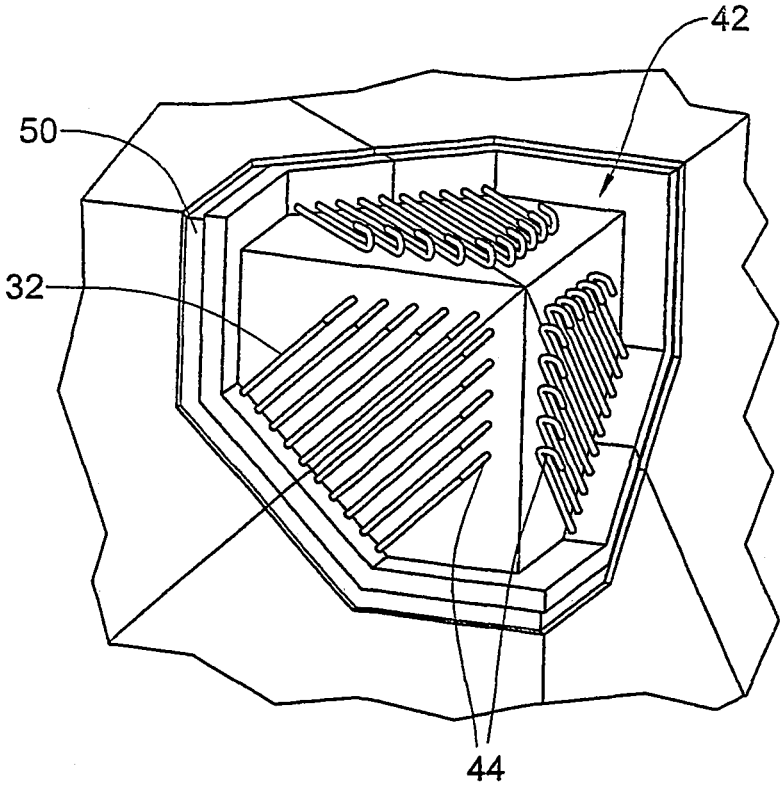
FIG. 5 is a close-up view of a reinforced corner of the 3-D module.

With reference to FIG. 1 and the enlarged view in FIG. 5, recesses 42 are formed on the cube's surface at the corners of the 3-D module. Ends 44 of the reinforcing rods 32 are exposed in these recesses. When two to eight 3-D modules 10 are arranged adjacent a common R-corner, for example corner 46 in FIG. 2, the recesses form cavities that serve as a mold for casting concrete or injecting grout to create corner joints 48. Similar recesses 52 may be formed along the R-diagonals, as shown in FIG. 1 and in FIG. 7 below, with parts of the RDBs also exposed in them. As shown in FIG. 5, imprints 50 are formed around the recesses 42 and 52 in order to hold appropriate gaskets such as inflatable tubes to seal the cavities.

The basic 3-D modules (FIG. 1) may have hollow watertight volumes in their body. Such volumes may constitute reservoirs that can be filled with seawater for ballast purposes, or with any other material, as needed (i.e., drinking water, fuel, sewage water, sand, and other materials). The hollow volumes in the modules amount to about a quarter of the volume of the enclosing cube and may be connectable through openings and shutoff valves, which facilitate full control of their contents. These elements can be inserted at any suitable place in the module walls and therefore are not shown in the figures.

The controllable volumes are large enough to provide the 3-D modules with buoyancy properties. By letting in air, the buoyancy of the 3-D module can be controlled, as well as that of the assembled structure as a whole.

Figure 6:
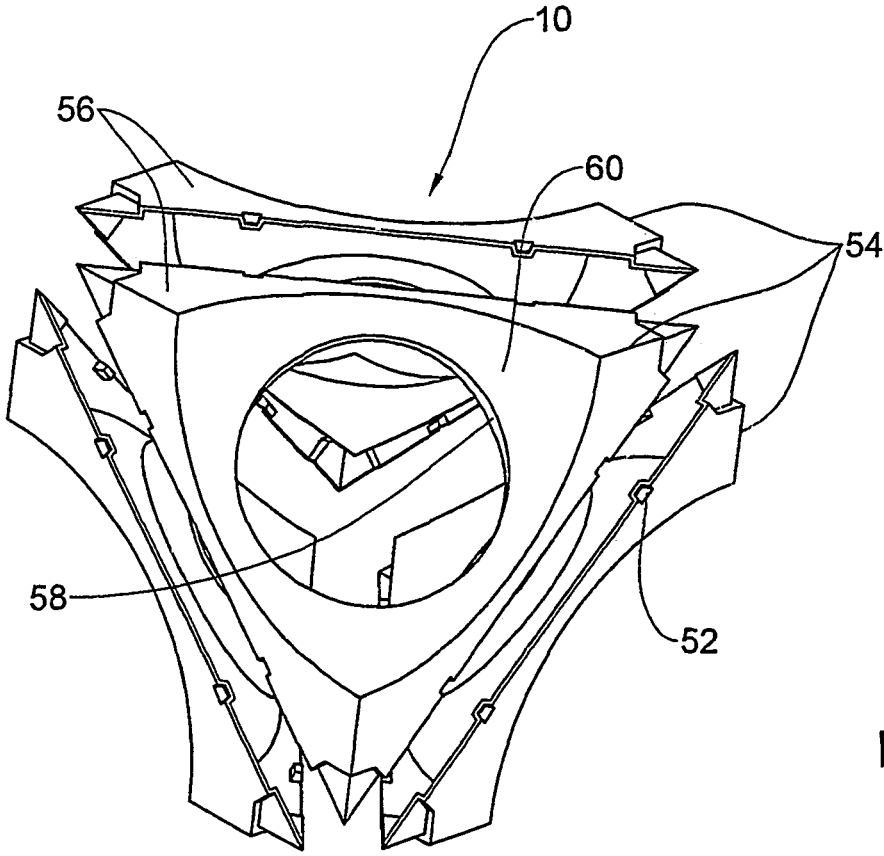
FIG. 6 is an exploded view of a 3-D module built of shell elements.

As shown in FIG. 6, the basic 3-D module 10 is built of four shell elements 54 which, in the assembled module, are tightly connected along seams on cube's diagonals. The shell elements 54 comprise planar walls (arches) 56, tunnel walls 58, and spherical walls 60, as seen also in FIG. 7. The recesses 52, on the edges of the shell elements 54, may be used to cast connectors between adjacent 3-D modules.

Figure 7:
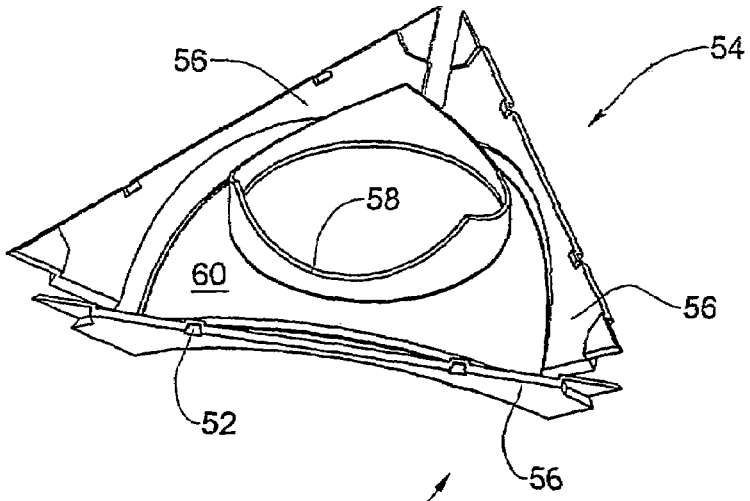
FIG. 7 is an exploded view of a shell element.

With reference to FIGS. 6, 7 and 8, the basic 3-D module is manufactured from shell elements 54 by the following process:

Stage "A": The shell elements 54 are fabricated by first casting three concrete arches 56. Casting can be performed horizontally in flat molds. Steel reinforcement rods 32 are used in order to create RDBs, with free rod ends 44 exposed in the recesses 42 for future connection. Recesses 52 are formed, and transverse reinforcement rods are also set (not shown), with free steel ends along edges of the shell elements for connection to the other shell parts in the next stages of the concrete casting.

Stage "B": Three arches 56 are placed, for each shell element 54, into a casting mold. Additional reinforcement rods for the RDB may be inserted into the molds, and also all fixed elements that must be embedded during casting such as flanges, valves and faucets for buoyancy control, hatches to open/close storage containers, lifting eyes, etc. The free steel ends may be connected, for example by welding. The shell element mold can be two-sided or one-sided, or a combination of both. For example, the tunnel walls 58 can be cast in two-sided molds. Preferably, for marine structures, the shell element molds are floating (buoyant), together with the cast concrete element.

Stage "C": Completing the production of the shell element by casting the concrete in the mold. The spherical walls 60 and the tunnel walls 58 are cast, and the gaps between the planar arches 56 are filled. Thus, all the parts are connected, and the shell element 54 is completed. Concrete curing can be performed inside the molds, and if required, while floating on the water. Upon completion of curing, the shell element 54 is ready for assembly with three other shell elements to form the 3-D module.

Figure 8A:
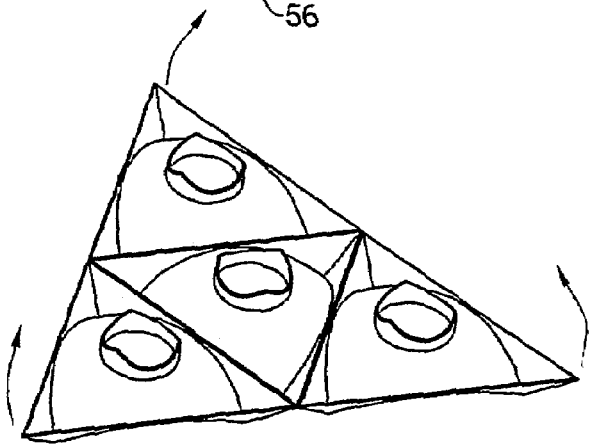
FIGS. 8A, 8B, and 8C show the process of folding of 4 hinged molds with shell element into a quasi-tetrahedron structure.

Stage "D": Four casting molds with shell elements 54 in them are coupled to each other by means of hinges; in a layout of four equilateral triangles forming a large foldable triangle (FIG. 8A).

Figure 8B:
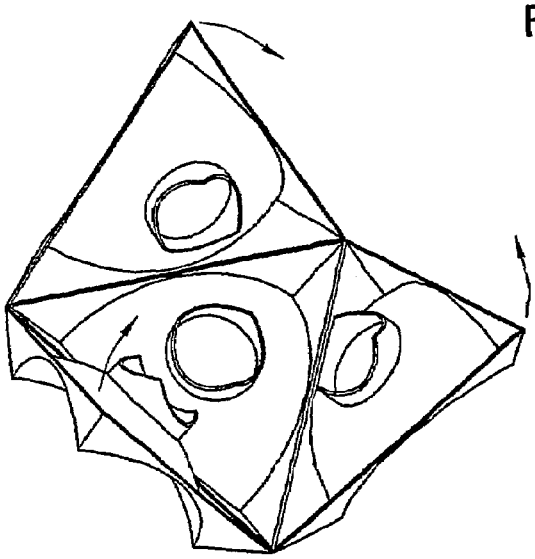
Figure 8C:
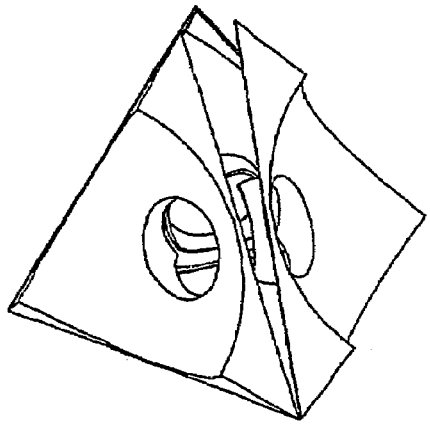

Stage "E": The casting molds, together with the shell elements 54, are "folded" (drawn together) around the hinges to form a "quasi-tetrahedron" structure (FIGS. 8B and 8C). The four shell elements are now locked into their accurate position in 3-dimensional space. At the end of this stage a large single external mold is created.

Figure 9:
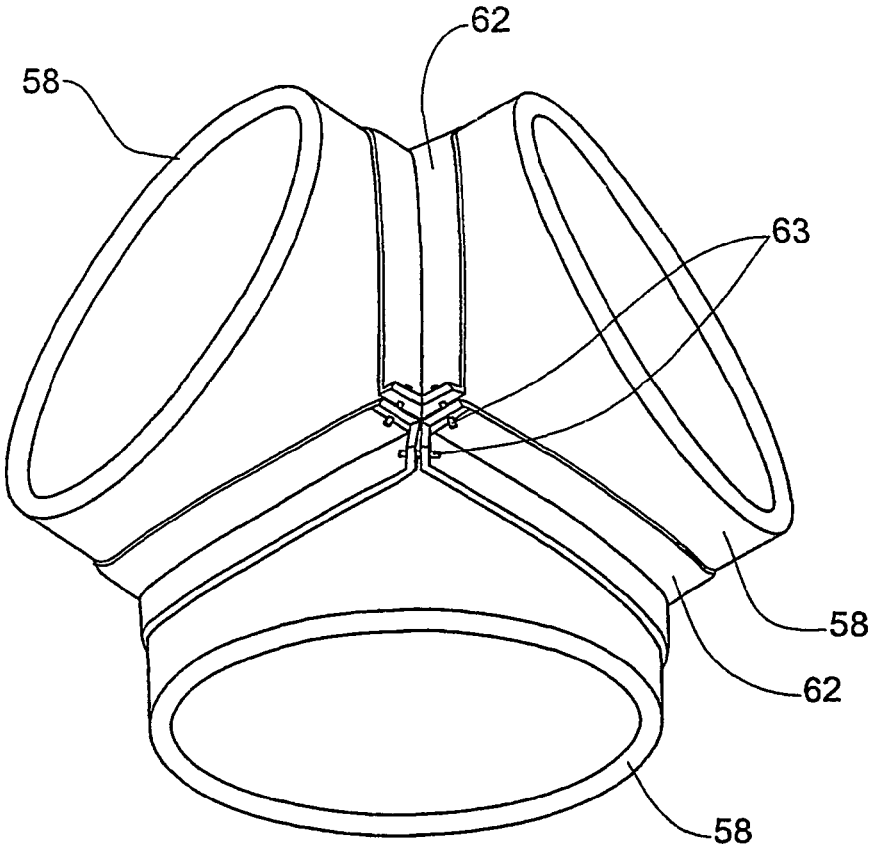
FIG. 9 is a perspective view of an elastic mold for casting seams of a tetrapod-like tunnel.

Stage "F": Upon closing the molds, the four tunnel walls 58 are also closed towards each other, forming a tubular tetrapod 61 (FIG. 9). Special arcuate belts 62 are inserted in the gaps between walls 58 and stretched by means of connecting elements 63 at the outer side of the walls (with respect to the passage through the tetrapod) so that the gaps between the walls 58 are closed from the internal side of the 3-D module. Now the joints between the edges of the tunnel walls 58 can be sealed by concrete casting or smearing of viscous mortar or shotcreting.

Stage "G": Bonding the "seams" between the edges of the shell elements 52. The ends of the transverse reinforcement rods are connected, and grout or concrete is injected between the edges of the shell elements. Closing the seams enables the 3-D module to attain its fullest strength and its planned structural behavior.

If the closed 3-D module and its mold have a floating capacity, the closed mold and the cured 3-D module within it are lowered into the water to a state of buoyancy. After the 3-D module and its mold have been balanced, as far as buoyancy is concerned, the mold is opened and the 3-D module is released, to float on the water. Its buoyancy can be controlled by ballast water, buoys and/or weights and lifting equipment.

Figure 10:
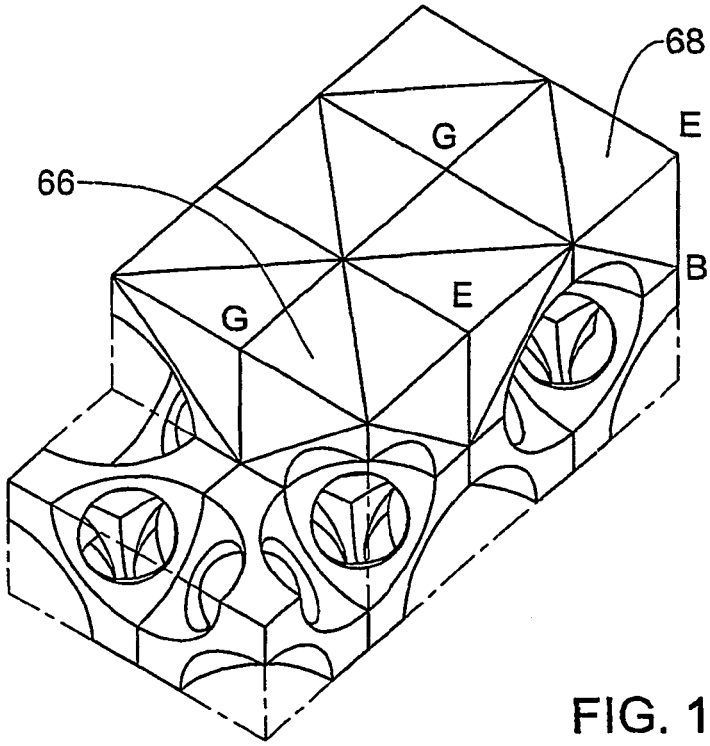
FIG. 10 is a surface structure assembled from 3-D modules with 1and 2 cut-out corners.

According to the present invention, other embodiments of the 3-D module are also proposed. For the purpose of obtaining a continuous flat structure surface, a special surface module 66 may be designed (FIG. 10). This module has only two out of the four non-adjacent corners cut out, corners E and G being full. A 3-D module 68 for an exposed corner of the assembled structure may have 3 corners full (only corner B is cut out).

Figure 11:
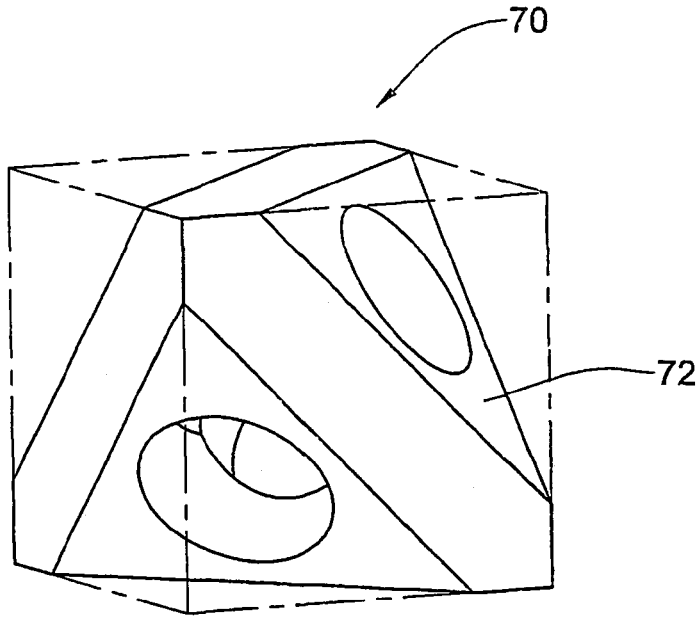
FIG. 11 is a perspective view of a flat-faced 3-D module.
Figure 12:
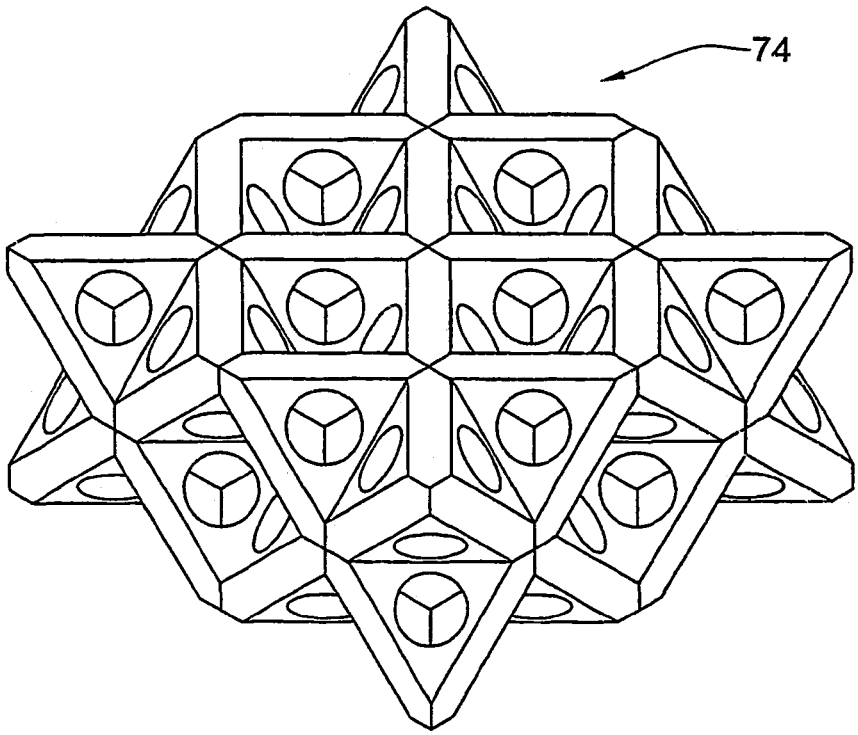
FIG. 12 is a perspective view of a structure assembled from flat-faced modules of FIG. 11.

A simplified flat-faced 3-D module 70 is shown in FIG. 11. The cut-out surfaces 72 in this case are planar. A structure 74 built from such flat-faced modules 70 is shown in FIG. 12. The spaces between this type of 3-D modules attain the shape of an octaheder instead of a sphere, as was shown in FIG. 2.

Figure 13:
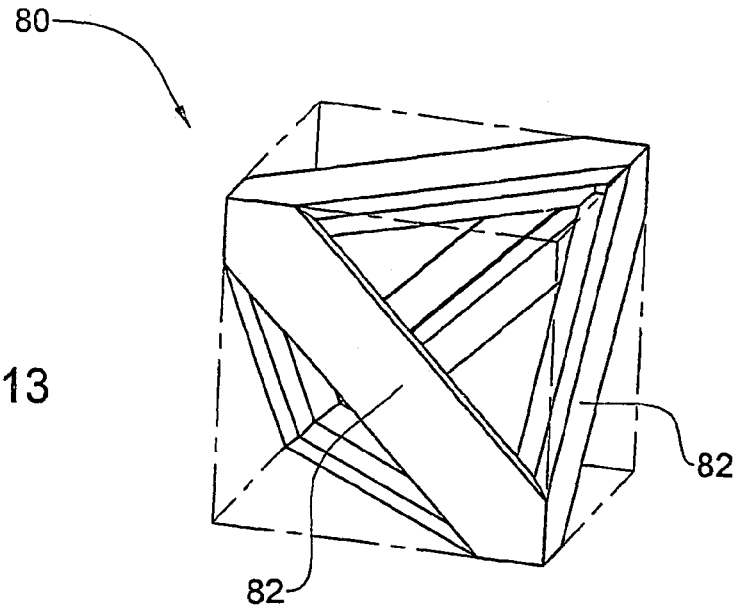
FIG. 13 is a perspective view of a "skeletal" 3-D module.
Figure 14:
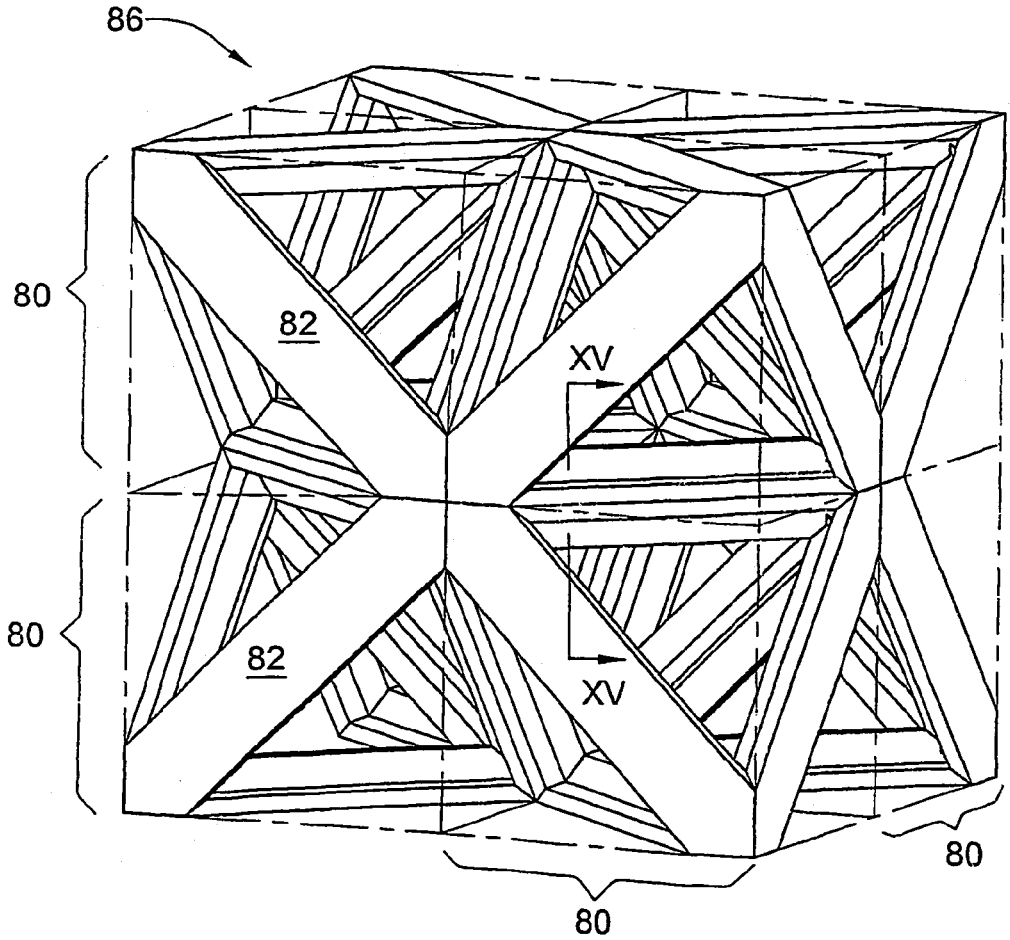
FIG. 14 is, a perspective view of a structure assembled from "skeletal" 3-D modules.

An alternative "skeletal" 3-D module 80 is shown in FIG. 13. The skeletal module has the same outer topology (four cut-out corners and four tunnels connected in a tetrapod) as the basic 3-D module, and also the same reinforcement structure made of RDBs. However, the skeletal module 80 has no hollow volumes and therefore no buoyancy. The skeletal module comprises six beams 82 of generally uniform cross-section arranged in a tetrahedron configuration. The cross-section of the beams may be rectangular but can also comprise an open channel 84 so that two adjacent skeletal modules will define a hollow space between them extending along the R-diagonal of the enclosing cube. An assembled structure with adjacent skeletal modules is shown in FIG. 14 and the cross-section of two adjacent beams 82 with channels 84 can be seen in FIG. 15A. The hollow space in the channels 84 has the same connective function as the cavities formed-by the recesses 42 or 52. Parts of the reinforcing elements may be exposed in that pace, for example ends or loops of transverse steel rods. The space is filled with rout or other setting material to fix together the RDBs of the adjacent modules and to improve the structural behavior of the assembled structure.

Figure 15A:
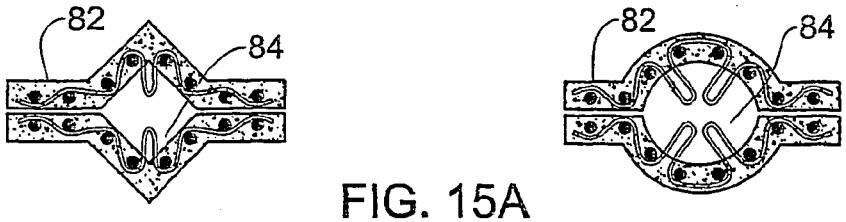
FIGS. 15A and 15B show different cross sections of the beams in the skeletal 3-D module.
Figure 15B:
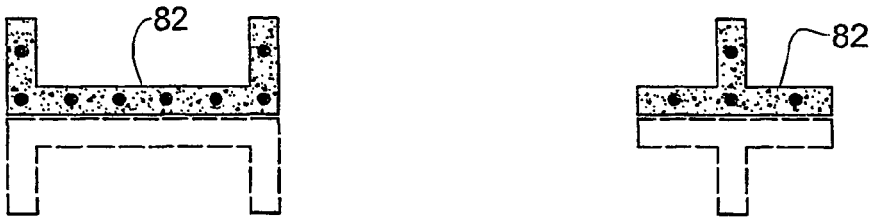

Another way to improve the structural behavior is to use a "T"-shaped or "U"-shaped cross-section of the beam, or any other shape that will increase the moment of inertia in the direction normal to the flat face of the beam 82 (see FIG. 15B).

The properties of the skeletal modules are similar to these of the basic 3-D module. They can be piled up like cubes, they can be interconnected in the same way as the basic 3-D modules, to form a large structure 86 (see FIG. 14) that behaves structurally as explained in connection with FIGS. 3 and 4.

A hollow concrete box, with or without openings in each or in part of its six faces, can serve as an alternative "cubic" 3-D module. This alternative may be buoyant if the box is closed and filled with air, or not buoyant if it has openings. It is different from any other concrete structural boxes known in the practice by its reinforcement, which is the same as in the basic 3-D module, e.g. by RDBs providing the "cubic" module with the structural properties of a tetrahedron. The ways of connection are the same as with the basic 3-D modules.

Figure 3:
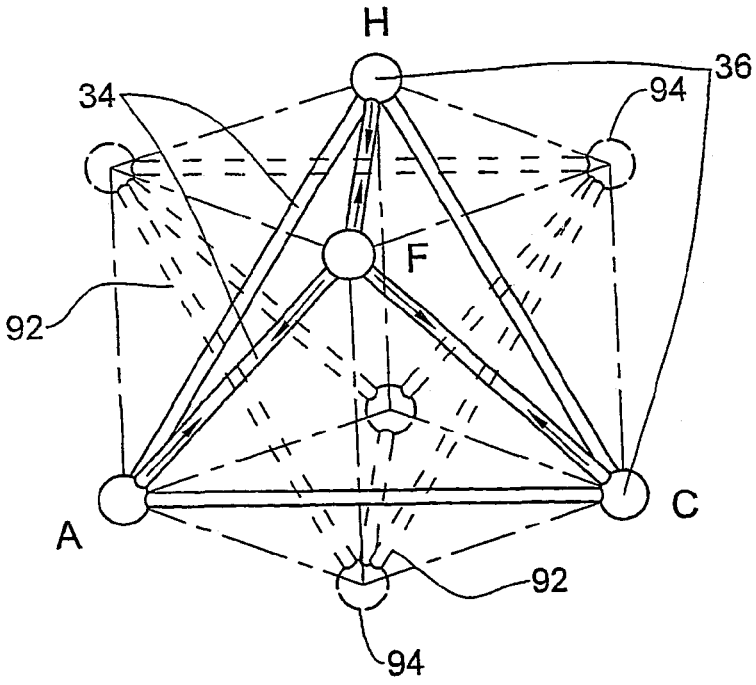
FIG. 3 is a schematic view of a single structural tetrahedron.
Figure 4:
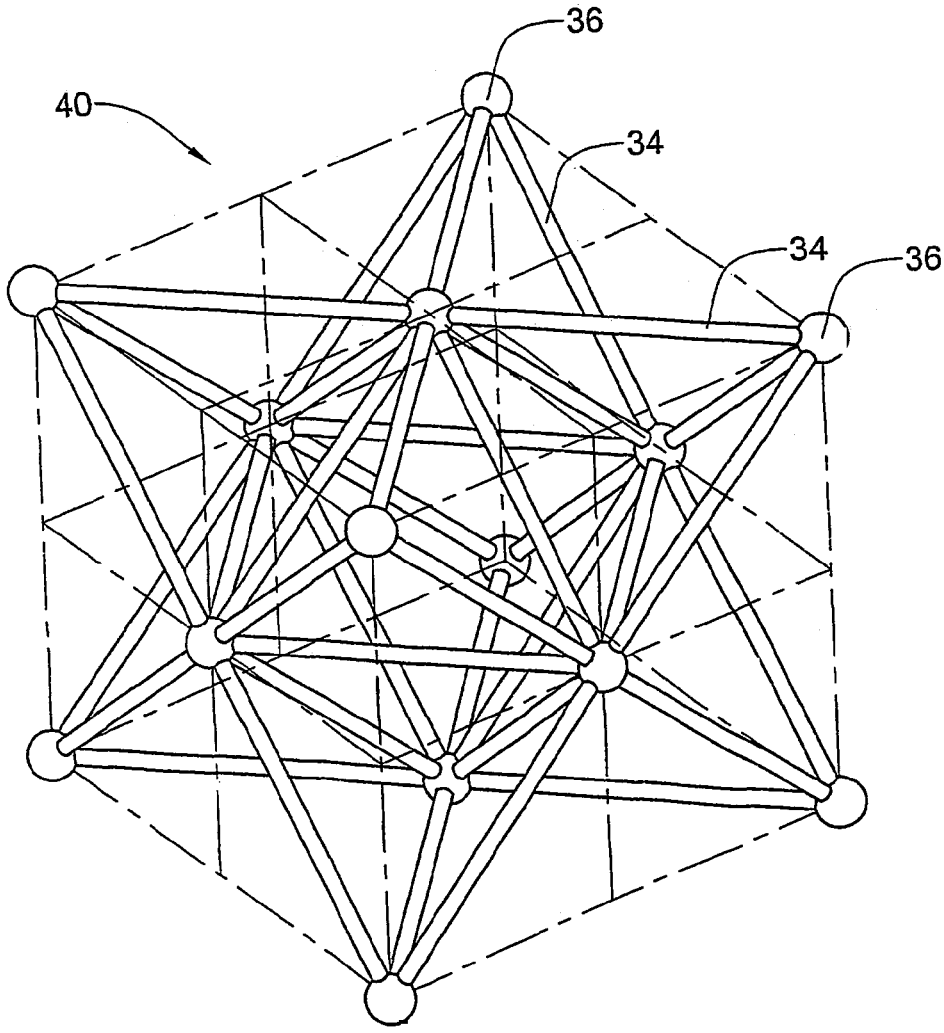
FIG. 4 is a schematic view of a multi-tetrahedron structure.
Figure 16:
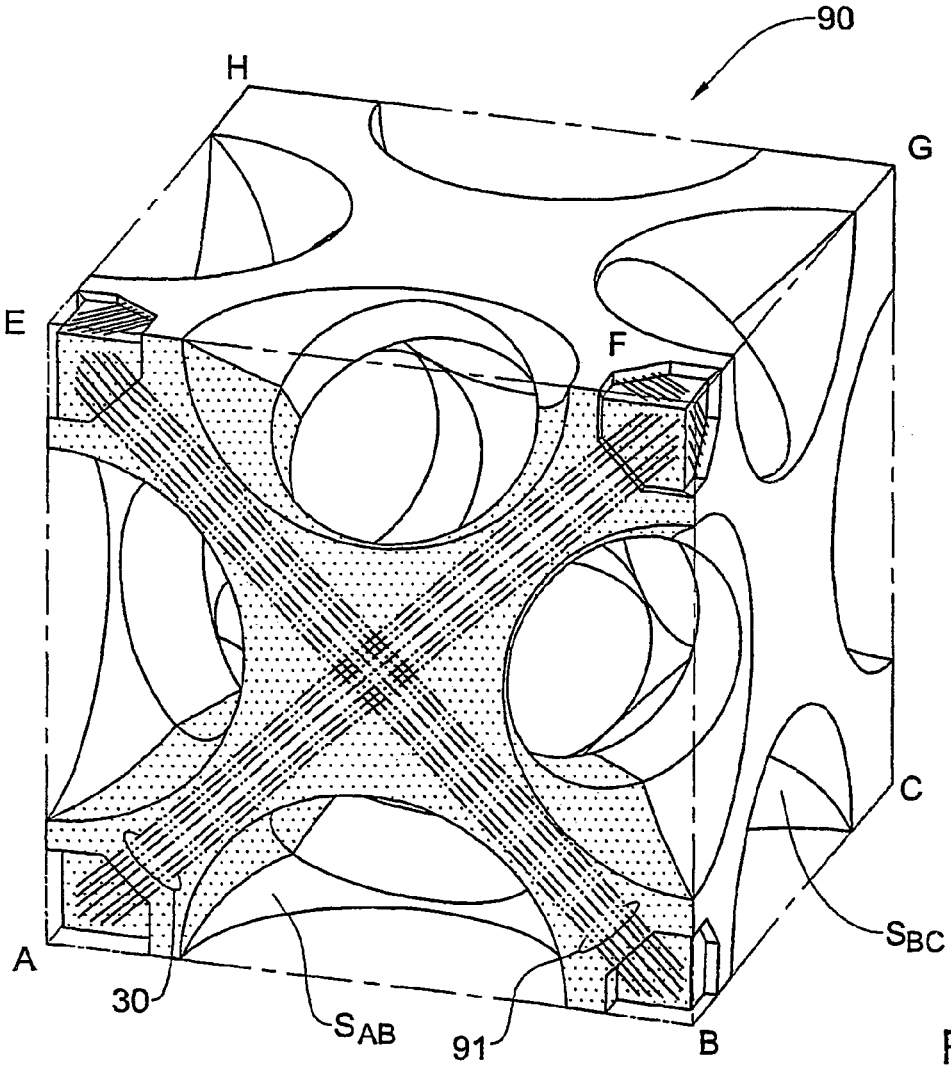
FIG. 16 is a perspective view of a "double" 3-D module of the present invention.

Another embodiment of the 3-D module of the present invention is a "double" 3-D module. The double module 90 shown in FIG. 16 has the RDBs of the basic module but comprises also a second set of six RDBs 91 extending along the other six diagonals (R2-diagonals) of the cube and forming a second tetrahedron shape. In FIG. 3, the second tetrahedron is schematized by rods 92 and vertex connectors 94 shown in broken lines. The structural behavior under load of the second tetrahedron is the same as that of the first one. In fact, the interaction between the two tetrahedrons is very weak despite the fact that their respective RDBs are embedded in the same module.

Figure 17:
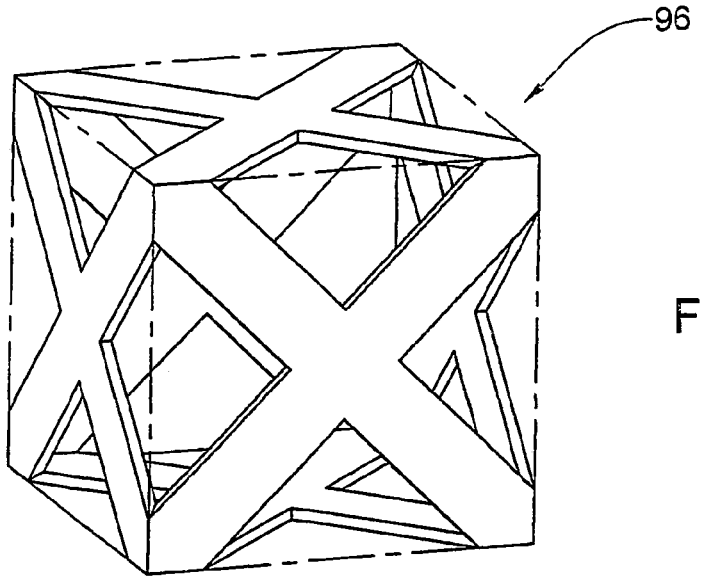
FIG. 17 is a perspective view of a double skeletal 3-D module.
Figure 18:
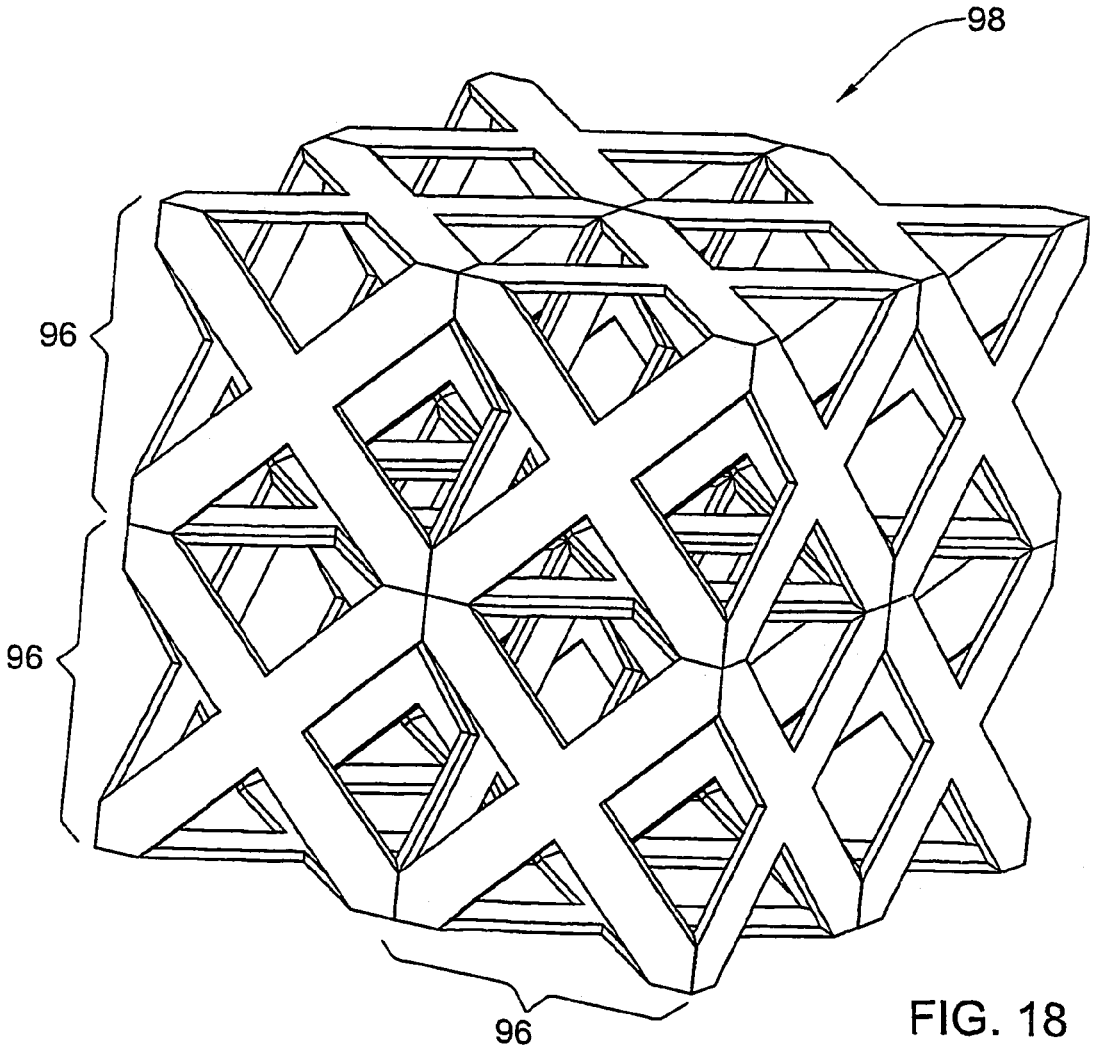
FIG. 18 is a perspective view of a structure assembled from double skeletal 3-D modules.

The double 3-D module 90 is cut out in a different way, since all its eight vertices are used as joints. Twelve spherical surfaces $S_{AD}$, $S_{AB}$, etc. are cut out around each edge of the cube, and twelve tunnels $T_{AB}$, $T_{BF}$, etc. are bored from the cut-out surfaces to the cube's center. The center of the cube may be further emptied by cutting out a central sphere. The cut-out surfaces may also haste different forms but the R1-diagonals and R2-diagonals must not be interrupted. The double module may have hollow water-tight volumes in its body like the basic module 10. It may be assembled from six module elements, each comprising two RDBs belonging to two different tetrahedrons, for example element ABFE (shown slightly shaded). The double 3-D module may be also assembled from shell elements. Alternatively, the module may be built as skeletal 3-D module 96 (see FIG. 17), and a structure 98 assembled from eight such modules is shown in FIG. 18.

Figure 19:
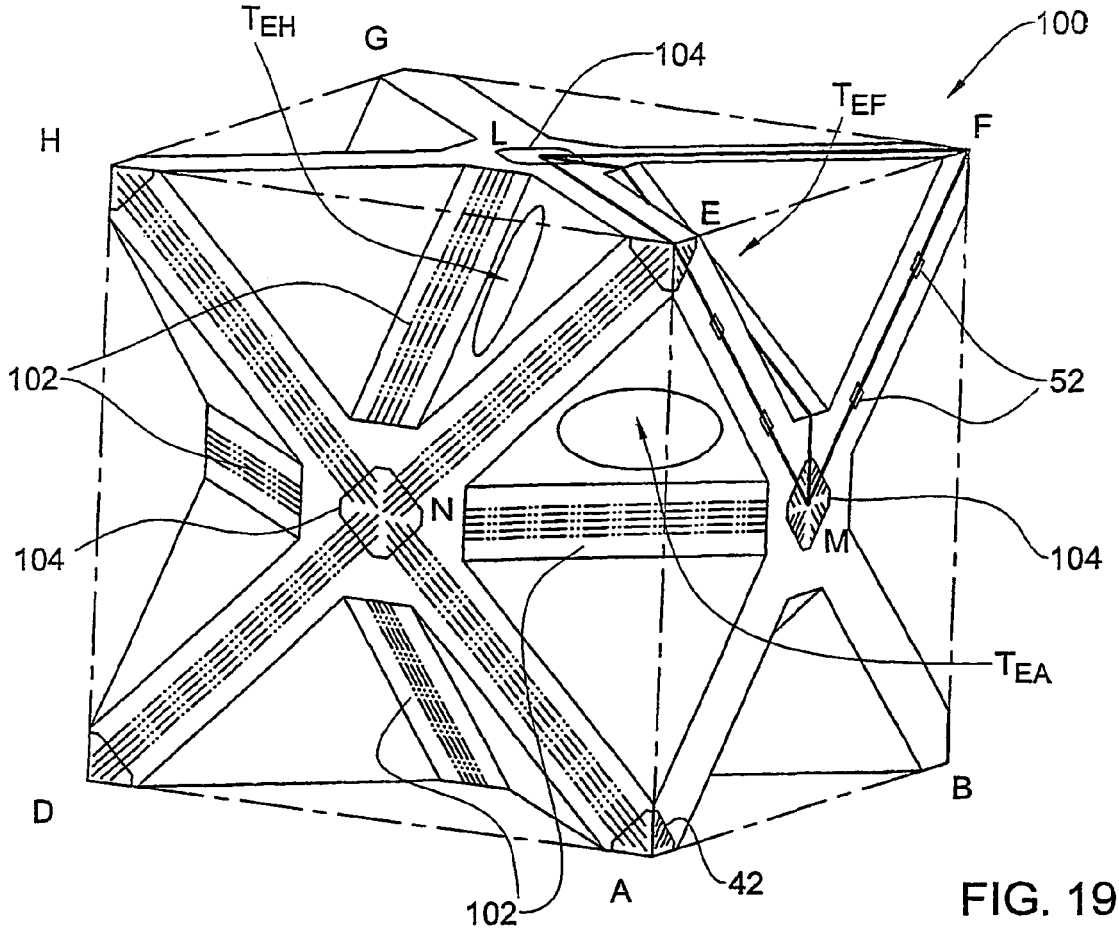
FIG. 19 is a perspective view of a "multiple" 3-D module of the present invention.

More RDBs can be added to produce various 3-D modules within the scope of the present invention. For example, as shown in FIG. 19, a "multiple" 3-D module 100 is obtained when twelve RDBs 102 connecting centers of the cube's faces are added to a double module to form an internal octahedron structure. The multiple module may be regarded as constituted by eight tetrahedrons (for example LMNE) attached to the internal octahedron structure. The structural scheme of the multiple module is in fact identical to that of the structure assembled from 8 basic 3-D modules (see FIG. 4). The multiple module may have tunnels, for example, $T_{EA}$, $T_{EF}$, $T_{EH}$ converging in a tripod shape under the corresponding vertex E. Recesses for formation of joints are provided both at cube's vertexes (recess 42), at cube's diagonals (recess 52), and at centers of cube's faces (recess 104). A multiple 3-D module may be assembled from 12 shell elements, such as EMFL. Three such shell elements may be first assembled in one casting mold to form an intermediate set AFHE, then four such sets may be assembled, together with the molds, into a 3-D module, as shown and explained in connection with FIGS. 8A, 8B and 8C. Alternatively, a shell element such as EMFL may be first assembled from subelements, such as LMB and LMF. Hollow volumes may be formed both in the internal octahedron structure and in the peripheral tetrahedrons.

Figure 22:
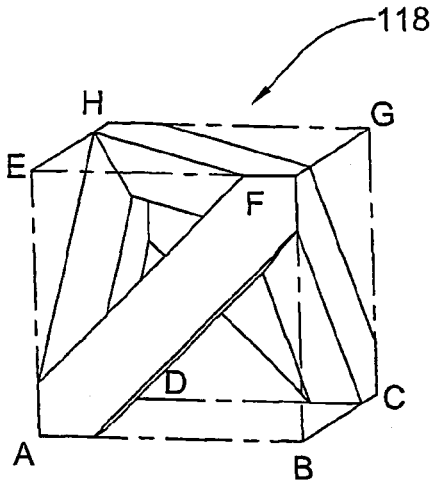
FIG. 22 is a perspective view of a "deficient" 3-D module with 5 RDBs on side diagonals.
Figure 21:
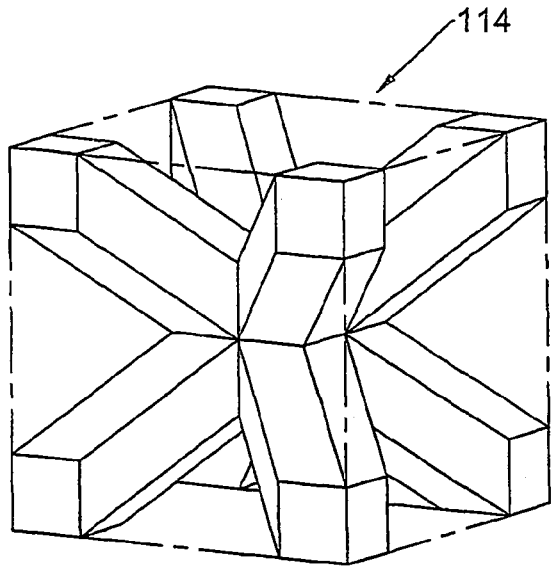
FIG. 21 is a perspective view of a "deficient " 3-D module with 4 RDBs on body diagonals.
Figure 23:
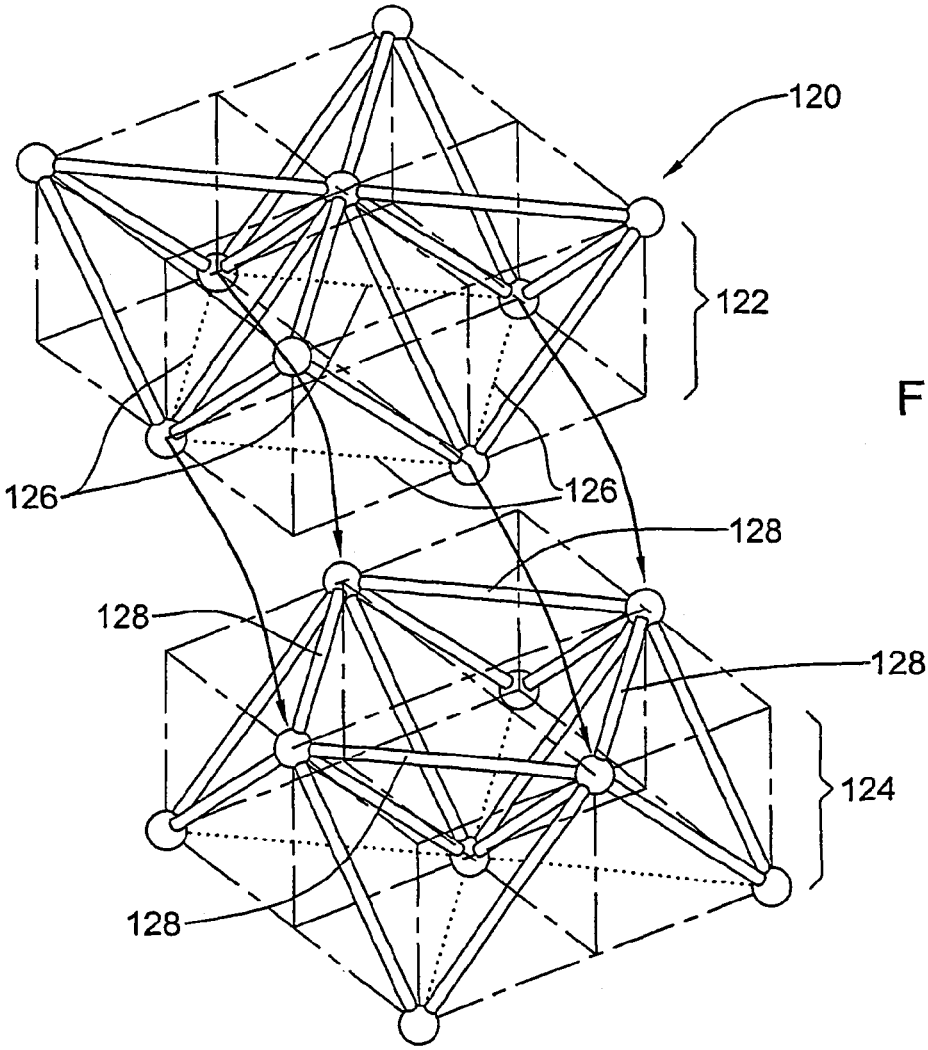
FIG. 23 is a schematic view of a complete tetrahedron lattice formed from "deficient" 3-D modules.

A "deficient" module is a 3-D module of the present invention where the constituent RDBs do not form a complete tetrahedron. For example, FIG. 21 shows a "deficient" 3-D module 114 having four RDBs along the four body diagonals of the enclosing cube in a double-cross formation. Alternatively, FIG. 22 shows a "deficient" 3-D module 118 having five RDBs along five of the facial diagonals of the enclosing cube, forming a spatial quadrangle AFCH with one diagonal FH. The structure of the last module may be also described as tetrahedron AFCH with the edge AC missing. A "deficient" module however becomes a part of a complete tetrahedron lattice when assembled with other 3-D modules in a modular structure. Such structure 120 is shown as a lattice in FIG. 23 where two layers 122 and 124 built of "deficient" 3-D modules 118 are set one over the other. The missing RDBs 126 in the upper layer 122 are competed in the assembled structure by RDBs 128 in the lower layer 124.

The alternative 3-D modules described above, namely—the basic 3-D module, the surface module, the flat-faced module, the skeletal module, the cubical module, the double module, the multiple module, and the "deficient" modules—are all modular and can replace each other, or be used in combination (interchangeable) according to specific planing requirements. Their interchangeability is provided by the same size of the enclosing parallelepiped, the flat surface along the R-diagonals, and the identical or compatible arrangements for joints along the corresponding R-diagonals. Moreover, the multiple module may be assembled with modules of half size, thereby providing for more flexible configurations of land and marine structures.

A marine structure is assembled from the above-described 3-D modules in the following way:

The seabed and foundations for erecting the marine structure are prepared by customary methods of using mechanical equipment for under-water civil works. If required, gravel filling or other methods may be used for stabilizing of the base.

The foundations for marine constructions are designed to carry the static and dynamic live loads, as well as the self loads and the dynamic loads existing in sea (currents, lifting force, tides, storms, waves, earthquakes, seaquakes, etc.). In addition, the foundations serve for leveling the 3-D modules in the structure.

A 3-D module, in floating condition, is transported (towed) in the water above the location intended for its placement. The module is connected to crane cables, and is rotated and lifted to its planned position, in order to fit into its final place in the structure.

The module is immersed into the water by letting a controlled amount of water into its hollow volume, by means of buoys or by means of a lifting crane, etc. The final fine positioning of the 3-D module into its proper place can be performed by conical leads (male and female), that are fitted in the modules during casting, or by other suitable methods.

After positioning of all the modules around a common R-corner (maximum eight modules around an R-corner) so that the recesses 42 of adjacent modules form a closed space that serves as a mold for casting a corner joint 48 (see FIG. 5 and FIG. 2), the connections between the adjacent 3-D modules may be completed in the following manner:

The joint mold is prepared for casting by insertion of gaskets, such as pneumatic or hydraulic inflatable tubes, in the imprints 50 (FIG. 5) which face each other in the narrow gap between the modules. The gaskets may be also fixed in the imprints, for example by gluing, before the assembly of the modules. Preferably, two sets of gaskets are used, each attached to the respective module and facing the other set, so that if one of the gaskets fails to inflate, the opposite one could seal the gap. Appropriate reinforcement may be inserted in the mold (reinforcing steel rods, reinforcing nets, reinforcing fibers, reinforcing pins or any other means of reinforcement), and the exposed ends 44 of the reinforcing rods 32 are connected. In cases where fewer than eight modules meet at the joint (i.e. on the structure boundaries), the mold may be closed by means of suitable enclosures;

A grout inlet pipe is provided in the upper end of the mold, from the direction of the spherical volume between the modules, preferably pre-set during the manufacture of the 3-D module. A seawater outlet pipe is provided in the bottom end of the mold, also preferably pre-set in the module, and a pipe for compressed air is also provided. The pneumatic/hydraulic inflatable tubes are inflated to seal the gap between the adjacent modules surrounding the closed space of the joint mold, Feeding compressed air into the mold space purges the seawater from the mold down the outlet pipe. Grout or other setting material is injected through the inlet pipe to fill the joint mold space. Upon curing the grout, the pressure in the inflatable sealing can be released.

Additional joints can be created between the 3-D modules, in a similar manner, for example using the recesses 52 for connecting elements (see FIGS. 1 and 7) or channels 84 (FIG. 15A). These connecting elements will make the RDBs around one R-diagonal, which belong to two modules or to four shell elements, work as an integral rod, thereby preventing a collapse of the RDBs under heavy loads.

The 3-D modules may be first assembled in floating macro-modules (groups) including 2 or more modules, which are then towed to the construction site, positioned and connected to the rest of the marine structure. In this case it is preferable to assemble the macro-module only by such joints that do not take part in the connection to the rest of the marine structure, i.e. using only the recesses 52, channels 84, or entirely internal R-corners.

The top layer of the marine structure, which is designed to rise above the sea level (taking into account high tides and waves), can be constructed from the "surface" modules 66 and 68 (FIG. 10).

The marine structure or any single 3-D module may be reinforced by filling of the hollow volumes in the 3-D module with grout or other setting material, thus turning them into a locally strengthened foundation suitable to assume bigger local loads.

Another option of local reinforcement, after the assembly of the structure, regardless of the design strength of the 3-D modules, is by erecting additional pillars. The cut-out surfaces and the tunnels in the 3-D modules may be shaped so as to leave through-open spaces along the structure. These spaces can be used for inserting pillars 110 down to the seabed (see FIG. 20). By using this option, there is no need to determine in advance the strength of the marine structure. Such pillars can be added at any time, and per need.

Figure 20:
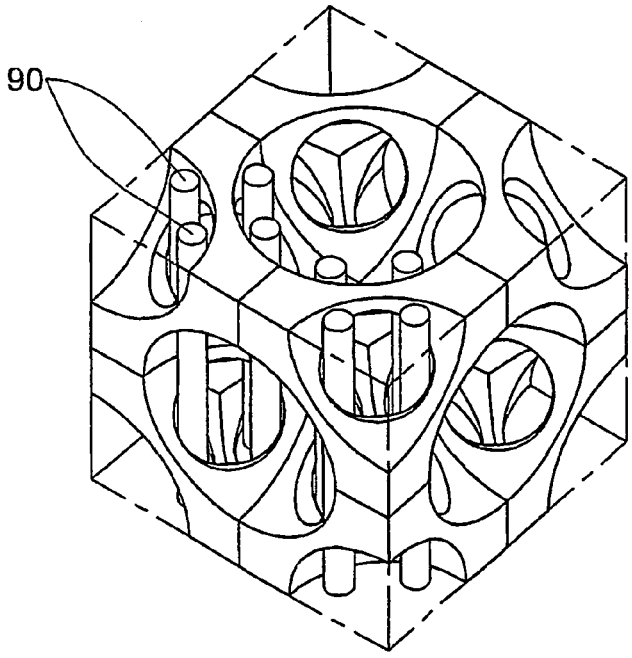
FIG. 20 is a perspective view of a structure assembled from basic 3-D modules and reinforced by vertical pillars.

The aforementioned open spaces allow inserting up to 4 pillars through one 3-D module. The diameter of the pillars 110 shown in FIG. 20 is 1.50 m in a module with dimensions 10×10×10 m and tunnel diameter of 6 m. This option can support considerable live loads, for all practical purposes.

Although a description of specific embodiments has been presented, it is contemplated that various changes could be made without deviating from the scope of the present invention. For example, the structural materials used for manufacturing the 3-D modules or the constituent shell elements are not limited to reinforced concrete. Polymer concrete, ash (flyash) concrete may be used, as well as reinforcing fibers of carbon, glass, plastic, or steel. The shell elements may be cast in fiber-reinforced-plastic (FRP) exterior shells used as cast molds, while the RDBs may be formed as FRP interior submembers.

As mentioned above, there is no need that the RDBs in each single 3-D module form a closed tetrahedron. A wide variety of "deficient" 3-D modules with some of RDBs missing may be designed within the scope of the present invention, even modules comprising only one or two RDBs, or RDBs that are not connected to each other. It is understood that such RDBs become members of the advantageous multi-tetrahedron-octahedron structure only when the "deficient" 3-D module is included in the assembled marine or land structure.

The invention claimed:

1. A 3-D structural module (3-D module) for assembly in a load-carrying modular structure, said 3-D module being designed as a body constituting a complete or partially cut-out parallelepiped with rectangular sides and comprising at least one reinforcing diagonal beam (RDB) disposed along a diagonal (R-diagonal) that connects vertices (R-comers) of said parallelepiped, said body having flat faces constituting parts of said rectangular sides, said RDB including means for rigid assembly to a RDB of another 3-D module, such that a plurality of 3-D modules can adjoin each other along their flat faces, and their RDBs can be assembled to each other at said flat faces so as to form a 3-D rigid multi-tetrahedron lattice in said modular structure, whereby said modular structure behaves under load as a multi-tetrahedron structure.

2. A 3-D module according to claim 1, wherein said at least one RDB includes reinforcing elements.

3. A 3-D module in accordance with claim 1 wherein said at least one RDB and said R-diagonal are disposed on a side of said parallelepiped.

4. A 3-D module in accordance with claim 1, wherein said parallelepiped is a cube.

5. A 3-D module in accordance with claim 1, wherein at least one corner of the parallelepiped, other than a R-corner, is cut out along a cut-out surface.

6. A 3-D module according to claim 5, wherein at least two of the cut-out surfaces and/or of the parallelepiped's faces of said 3-D module are interconnected by a tunnel.

7. A 3-D module in accordance with claim 6, wherein four corners of the parallelepiped other than R-comers are cut out along four respective cut-out surfaces and are interconnected by four tunnels converging near the parallelepiped's center in a tetrapod shape.

8. A 3-D module according to claim 7, wherein said cut-out surfaces and said tunnels are so shaped that portions of said 3-D module accommodating said RDB are formed essentially as beams of uniform cross-section extending along said R-diagonals.

9. A 3-D module according to claim 7, wherein said cut-out surfaces and said tunnels are shaped so as to provide a free passage for a column extending parallel to an edge of the parallelepiped.

10. A 3-D module according to claim 5, wherein at least one of said cut-out surfaces is a planar surface.

11. A 3-D module according to claim 5, wherein said at least one cut-out surface is an ellipsoid or spherical surface centered at the respective cut-out corner.

12. A 3-D module according to claim 3, wherein said means for assembly comprises at least one recess in at least one of said flat faces of said body, at said side R-diagonal of the parallelepiped, said at least one recess being so disposed as to define a cavity with a corresponding recess in another 3-D module when said modules are arranged adjacent to each other.

13. A 3-D module according to claim 12, wherein said at least one recess is a channel on said flat face, extending along said side R-diagonal.

14. A 3-D module according to claim 12, wherein said at least one recess is in one of said R-corners of the parallelepiped.

15. A 3-D module according to claim 12, comprising reinforcing elements, parts of said reinforcing elements being exposed in said at least one recess.

16. A 3-D module according to claim 12, wherein said recess is formed with a peripheral channel for accommodating a sealing element to seal said cavity.

17. A 3-D module according to claim 1, comprising a closed fluid-tight hollow volume and means enabling filling and draining said hollow volume with a fluid.

18. A 3-D module according to claim 7, wherein said 3-D module is assembled from four shell elements with generally triangular shape, each shell element comprising a wall of one of said tunnels, each two shell elements being sealingly joined by their edges along a side R-diagonal of the parallelepiped and along a joint of walls of two respective tunnels.

19. A structural shell element for assembling a 3-D module according to claim 18, said shell element having a generally triangular shape, comprising a wall of one of said tunnels and three generally planar walls forming the flat faces of the 3-D module, such that two such shell elements can be joined by their edges along a side R-diagonal of the parallelepiped and along a joint of walls of their tunnels.

20. A mold for casting the structural shell element of claim 19, said mold having a generally triangular shape and comprising hinges at edges of the triangle, such that said mold can be assembled edge-to-edge by means of said hinges in a group of four similar molds lying in one plane, said hinges allowing conversion of said group of molds, together with shell elements cast therein, into a 3-D tetrahedron structure by lifting three of said four molds and turning them about said hinges.

21. A mold according to claim 20, further having floating means, such that the assembling in said group, said casting and said conversion can be performed afloat.

22. A mold for pre-casting individually the planar walls of the structural triangular shell element of claim 19.

23. A method of production of the 3-D structural module of claim 18, the method comprising:

a) casting said four shell elements in four respective shell casting molds;

b) disposing three of said casting molds around the fourth casting mold, and coupling edges of said three casting molds to edges of said fourth casting mold by means of hinges;

c) assembling a 3-D tetrahedron structure by lifting said three casting molds and turning them about the hinges; and d) bonding joints between the edges of the shell elements along the side R-diagonals, and bonding the joints between the walls of the tunnels, so as to obtain a hollow fluid-tight 3-D structural module upon releasing it from said molds.

24. A method of production of a 3-D structural module according to claim 23, wherein the step (a) is performed by pre-casting three planar walls for each shell element and then placing said planar walls in said casting mold for the shell element.

25. A method of production of a 3-D structural module according to claim 23, wherein the steps (a) to (d) are performed by using floating casting molds which are kept together with said 3-D module until an additional step of ballasting, balancing and releasing the 3-D module from the floating casting molds.

26. A method for assembling a load-carrying modular structure from the 3-D structural modules of claim 1, said 3-D modules having recesses at said flat faces, on R-diagonals passing through said flat faces, the method comprising:

a) transportation and fixing at least two of said 3-D modules adjacent to each other and aligned so that their respective enclosing parallelepipeds have a common R-diagonal and some of their flat faces with recesses abut each other; and b) formation of joint elements in cavities defined by said recesses along said common R-diagonal to bond said at least two 3-D modules together, thereby obtaining a mechanical structure behaving under load essentially as a multi-tetrahedron structure.

27. A method according to claim 26, wherein the formation of at least one of said joint elements is made by sealing the respective cavity between said adjacent 3-D modules, providing an inlet pipe and an outlet pipe to said cavity, and injecting grout or other setting material through said inlet pipe, to fill said cavity.

28. A method according to claim 26, wherein the sealing of said respective cavity is made by placing inflatable gaskets between said adjacent 3-D modules and inflating them.

29. A method according to claim 26, wherein said structure is a marine submerged structure, at least one of said 3-D modules has a hollow volume and therefore buoyancy, and said step (a) is performed by moving said at least one 3-D module in floating state over a predetermined place in the structure and by lowering it to said predetermined place by controlled filling of said hollow volume with water.

30. A method of forming a cast joint in a closed space defined at least between two adjacent constituent modules according to claim 1, the method comprising:

a) providing pipes for fluid communication between said closed space and (1) a source of flowable setting material, and (2) ambient water;

b) providing one or more inflatable tube-shaped gaskets in said narrow gap, said gaskets surrounding said closed space and being connected to a source of pressurized fluid;

c) inflating said gaskets with pressurized fluid so as to seal said narrow gap surrounding said closed space;

d) filling said closed space with setting material via said pipe (1) under pressure.

31. A method of forming a cast joint according to claim 30, further comprising one or more of the following:

providing a pipe (3) for fluid communication between said closed space and a source of pressurized air, and purging the water from said closed space via said pipe (2) by feeding pressurized air via said pipe (3) before step (d);

providing at least one of said modules with a recess constituting a part of said closed space;

providing at least one of said pipes (1), (2) and (3) as a built-in detail during the manufacture of said adjacent modules;

obtaining at least one of said pipes (1), (2) and (3) via said narrow gap or via a surface channel in said adjacent modules;

providing a channel in at least one of said adjacent modules, said channel surrounding said closed space and being adapted to accommodate said gaskets;

providing two sets of gaskets, each fixed to one of said adjacent modules, opposite to each other in sad narrow gap, so that the gap could be sealed in case one of two opposing gaskets should fail to inflate; and providing an additional enclosure for said closed space if the latter is not entirely enclosed between said adjacent modules.

32. A 3-D module according to claim 3 comprising a first set of six RDBs extending along six side diagonals (R1-diagonals) connecting four non-adjacent corners (R1-corners) of said parallelepiped, said RDBs forming a tetrahedron so that said 3-D module behaves under load applied in any of said R1-corners essentially as a tetrahedron built of six rods connected in four vertices.

33. A 3-D module according to claim 32, further comprising a second set of six RDBs extending along six side diagonals (R2-diagonals) of said parallelepiped different from said R1-diagonals, connecting four non-adjacent corners (R2-corners) and forming a second tetrahedron so that said 3-D module behaves under load applied in any of said R2-corners essentially as a tetrahedron built of six rods connected in four vertices.

34. A 3-D module according to claim 33, wherein a portion of said parallelepiped adjacent to at least one of parallelepiped's edges is cut out along a cut-out surface.

35. A 3-D module according to claim 33, wherein from two to twelve tunnels are cut out of said parallelepiped, each tunnel starting at one of parallelepiped's edges, all tunnels converging near the parallelepiped's center.

36. A 3-D module according to claim 35, wherein said tunnels are so shaped that portions of said 3-D module accommodating said RDBs are formed essentially as beams of uniform cross-section extending along said R1-diagonals and said R1-diagonals.

37. A module element for assembly of the 3-D module of claim 33, said module element comprising one RDB along a R1-diagonal and one RDB along a R2-diagonal, such that said 3-D module can be assembled from six such module elements arranged along sides of the parallelepiped.

38. A 3-D module according to claim 33, further comprising a third set of twelve RDBs extending along twelve diagonals (R3-diagonals) connecting intersections of said R1-diagonals and said R2-diagonals and forming an octahedron, so that said 3-D module behaves under load essentially as a multi-tetrahedron structure built of eight tetrahedrons arranged about one octahedron.

39. A 3-D module according to claim 38, assembled from module elements, at least one of said module elements comprising one RDB along a R3-diagonal, parts of two RDBs along two R1-diagonals, and parts of two RDBs along two R2-diagonals.

40. A 3-D module according to claim 38, assembled from module elements, at least one of said module elements comprising part of one RDB along a R3-diagonal and parts of two RDBs along two R1-diagonals.

* * * * *

UNITED STATES PATENT AND TRADEMARK OFFICE

CERTIFICATE OF CORRECTION

PATENT NO. : 7,226,245 B2
APPLICATION NO. : 10/482080
DATED : June 5, 2007
INVENTOR(S) : Eliyahu Kent et al.

It is certified that error appears in the above-identified patent and that said Letters Patent is hereby corrected as shown below:

On the title page, item [73] Assignee should read:

--Ocean Brick System (O.B.S.) Ltd., Herzliya (IL)--.

Signed and Sealed this

Eighth Day of July, 2008

JON W. DUDAS
*Director of the United States Patent and Trademark Office*